US009281634B2

(12) United States Patent
Katayanagi

(10) Patent No.: US 9,281,634 B2
(45) Date of Patent: Mar. 8, 2016

(54) USB RECEPTACLE

(71) Applicant: Japan Aviation Electronics Industry, Limited, Tokyo (JP)

(72) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/444,227

(22) Filed: Jul. 28, 2014

(65) Prior Publication Data

US 2015/0064958 A1 Mar. 5, 2015

(30) Foreign Application Priority Data

Aug. 27, 2013 (JP) ..... 2013-175352

(51) Int. Cl.
*H01R 13/66* (2006.01)
*H01R 29/00* (2006.01)

(52) U.S. Cl.
CPC ..... *H01R 13/6683* (2013.01); *H01R 29/00* (2013.01)

(58) Field of Classification Search
USPC ..... 439/188, 489, 342, 660, 366; 200/51.09; 361/33.1
See application file for complete search history.

(56) References Cited

U.S. PATENT DOCUMENTS 8,690,608 B2 * 4/2014 Naito et al. ..... 439/660

FOREIGN PATENT DOCUMENTS

| | | | |
|---|---|---|---|
| CN | 202094354 | U | 12/2011 |
| JP | 3172188 | U | 11/2011 |
| JP | 2012-138383 | A | 7/2012 |
| JP | 2013-030452 | A | 2/2013 |
| JP | 2013-069656 | A | 4/2013 |

* cited by examiner

*Primary Examiner* — Alexander Gilman
(74) *Attorney, Agent, or Firm* — Collard & Roe, P.C.

(57) ABSTRACT

A USB receptacle is mateable along a predetermined direction with a special USB plug comprising an identifiable portion. The USB receptacle comprises a holding member and a detector. The holding member includes a body portion having a plate-like shape extending in the predetermined direction. The detector is held by a side portion of the body portion. The detector has a contact portion. The contact portion does not overlap the body portion at all in a vertical direction perpendicular to the predetermined direction. When the USB receptacle and the special USB plug are mated with each other, the identifiable portion of the special USB plug is connected to the contact portion of the detector.

9 Claims, 14 Drawing Sheets

USB RECEPTACLE

CROSS REFERENCE TO RELATED APPLICATIONS

An applicant claims priority under 35 U.S.C. §119 of Japanese Patent Application No. JP2013-175352 filed Aug. 27, 2013.

BACKGROUND OF THE INVENTION

This invention relates to a connector, or a universal serial bus (USB) receptacle, mateable with at least two kinds of mating connectors (plugs), wherein the connector comprises a detecting structure to identify the kind of the mating connector mated with the connector.

For example, this type of connector is disclosed in JP-A 2013-30452 (Patent Document 1), the content of which is incorporated herein by reference.

As shown in FIGS. 27 and 28, the connector disclosed in Patent Document 1 is a USB receptacle compliant with a USB standard. This USB receptacle is selectively mateable with a standard USB plug (not shown) compliant with the USB standard or a special USB plug along a mating direction. The special USB plug comprises a special shell made of a conductive material such as a metal. The special shell has an identifiable portion which is not included in the standard USB plug. The USB receptacle comprises a shell made of a conductive material, a holding member made of an insulating material such as a resin and a detector made of a conductive material. The holding member is covered by the shell while holding the detector.

When the USB receptacle and the special USB plug are mated with each other along the mating direction, the identifiable portion of the special shell is brought into contact with and is electrically connected with the detector so that the USB receptacle can detect that the special USB plug is mated therewith. Accordingly, the USB receptacle mated with the special USB plug can work differently from the USB receptacle mated with the standard USB plug.

When the USB receptacle of Patent Document 1 is mated with the special USB plug, the identifiable portion of the special shell is moved along a side surface of the holding member. At that time, an end of the identifiable portion might be brought into abutment with the side surface of the holding member to shave the side surface. As a result, the shavings might be carried to the detector by the identifiable portion to adhere to the detector. When the shavings adhere to the detector, the detector and the identifiable portion might not be preferably electrically connected with each other.

SUMMARY OF THE INVENTION

It is therefore an object of the present invention to provide a USB receptacle comprising a detector which is to be brought into contact with an identifiable portion of a USB plug, wherein electrical connection between the detector and the identifiable portion can be preferably kept.

One aspect of the present invention provides a USB receptacle with which is selectively mateable with and removable from a standard USB plug or at least one kind of special USB plug along a predetermined direction. The standard USB plug is compliant with a USB standard and comprises a standard shell made of a conductive material. The special USB plug has a structure different from a structure of the standard USB plug and comprises a special shell made of a conductive material. The special shell includes a predetermined section and an identifiable portion, wherein the predetermined section has a shape same as a shape of the standard shell, and the identifiable portion projects beyond the predetermined section in the predetermined direction. The USB receptacle comprises a plurality of contacts, a holding member made of an insulating material, a shell made of a conductive material and a detector made of a conductive material. Each of the contacts has a contact part. The holding member holds the contacts and arranges the contacts in a pitch direction perpendicular to the predetermined direction. The holding member has a body portion. The body portion has a plate-like shape which extends in the predetermined direction while having a thickness in a vertical direction perpendicular to both the predetermined direction and the pitch direction. The contact parts of the contacts are arranged on an upper surface of the body portion. The shell encloses the holding member in a plane perpendicular to the predetermined direction. The shell is connected to the standard shell when the USB receptacle is mated with the standard USB plug, and the shell is connected to the special shell when the USB receptacle is mated with the special USB plug. The detector is other than the shell. The detector is held by one of opposite side portions of the holding member not to be directly connected to the shell. The detector has a contact portion. The contact portion is arranged at a position where the standard shell does not reach when the USB receptacle is mated with the standard USB plug. The contact portion is movable in a horizontal plane perpendicular to the vertical direction. The contact portion does not overlap the body portion of the holding member at all in the vertical direction. The contact portion is connected to an inside of the identifiable portion of the special shell in the pitch direction when the USB receptacle is mated with the special USB plug.

According to the present invention, the contact portion of the detector does not overlap the body portion of the holding member at all in the vertical direction. Accordingly, even if the side surface of the body portion is shaven by the identifiable portion of the special USB plug, the shavings do not arrive at the contact portion of the detector. The electrical connection between the detector and the identifiable portion can be therefore kept preferably.

An appreciation of the objectives of the present invention and a more complete understanding of its structure may be had by studying the following description of the preferred embodiment and by referring to the accompanying drawings.

Figure 1:
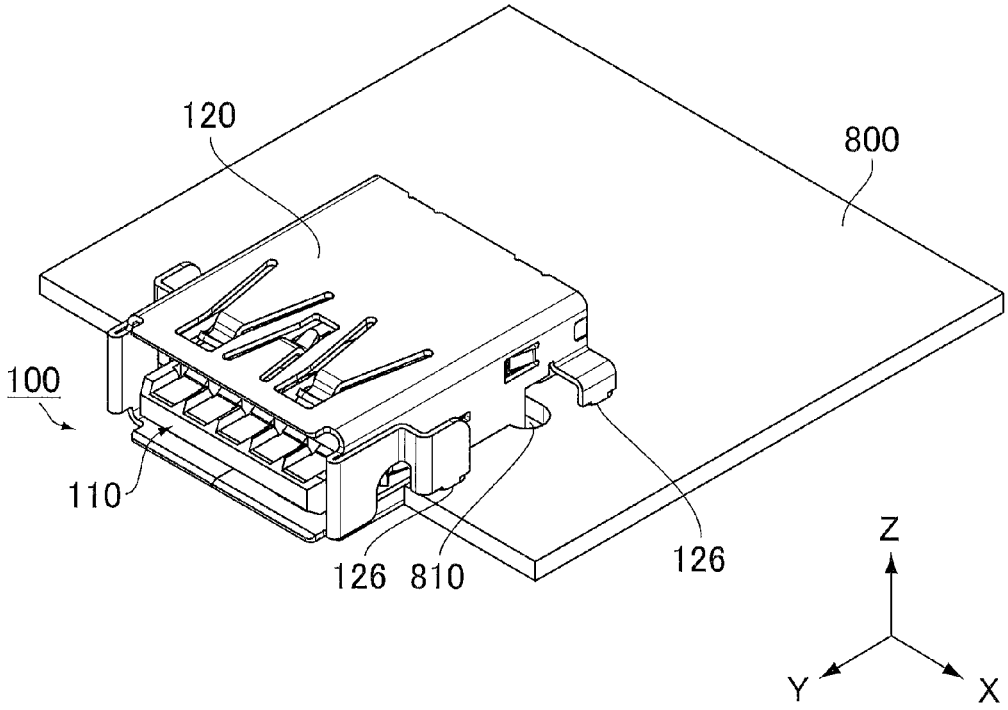
FIG. 1 is a perspective view showing a USB receptacle according to an embodiment of the present invention, wherein the USB receptacle is attached to a circuit board.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a USB receptacle 100 according to an embodiment of the present invention is a so-called drop-in connector which is to be put within a cut 810 of a circuit board 800. However, the present invention is also applicable to a connector other than the drop-in connector. For example, the present invention is applicable to a so-called on-board connector.

Figure 19:
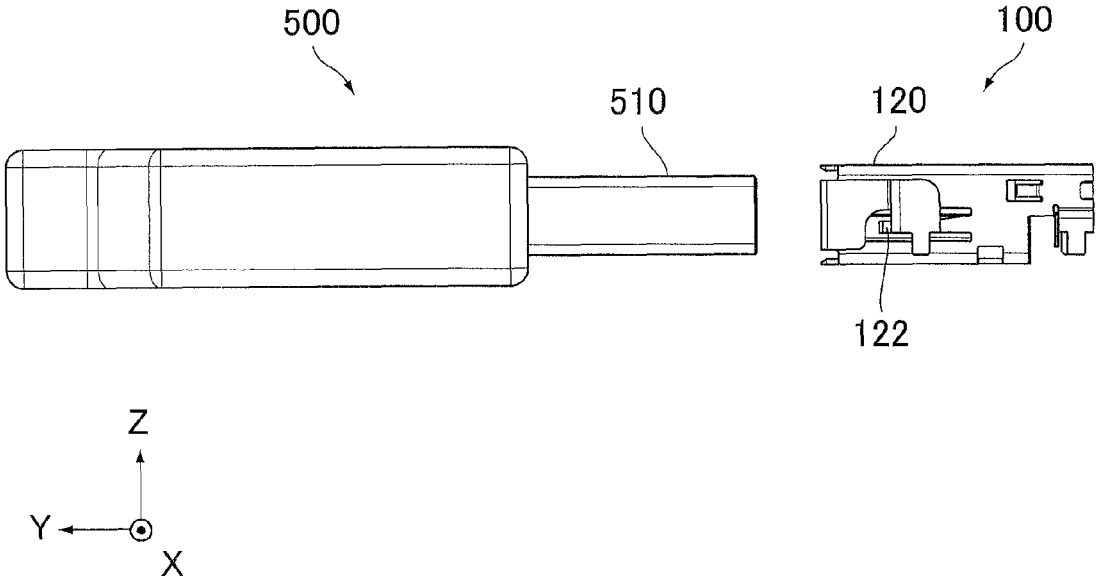
FIG. 19 is a side view showing the USB receptacle of FIG. 2 and the special USB plug of FIG. 7, wherein the USB receptacle and the special USB plug are in an unmated state.
Figure 20:
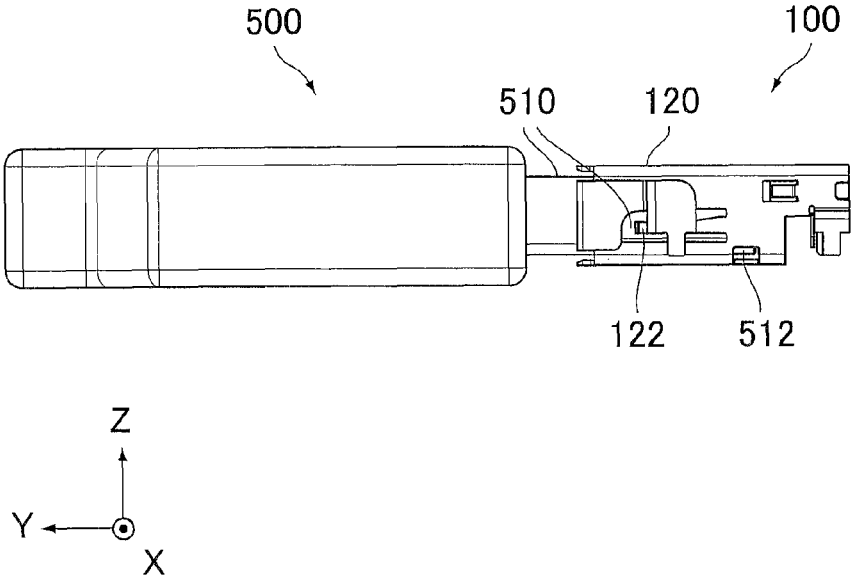
FIG. 20 is a side view showing the USB receptacle and the special USB plug of FIG. 19, wherein the USB receptacle and the special USB plug are in a mated state.
Figure 21:
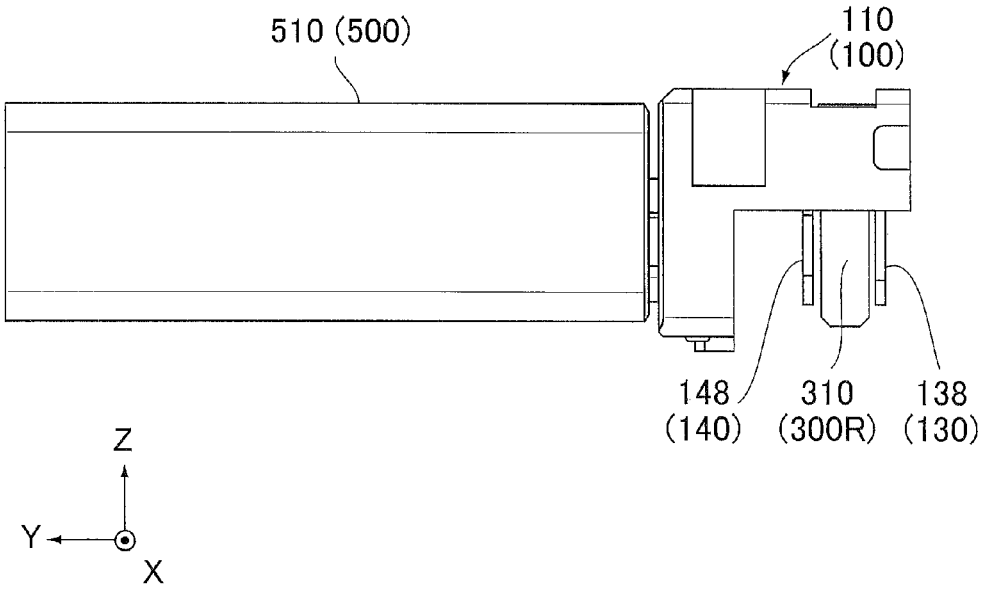
FIG. 21 is a side view showing the USB receptacle and the special shell of the special USB plug of FIG. 20, wherein a shell of the USB receptacle is not illustrated.
Figure 22:
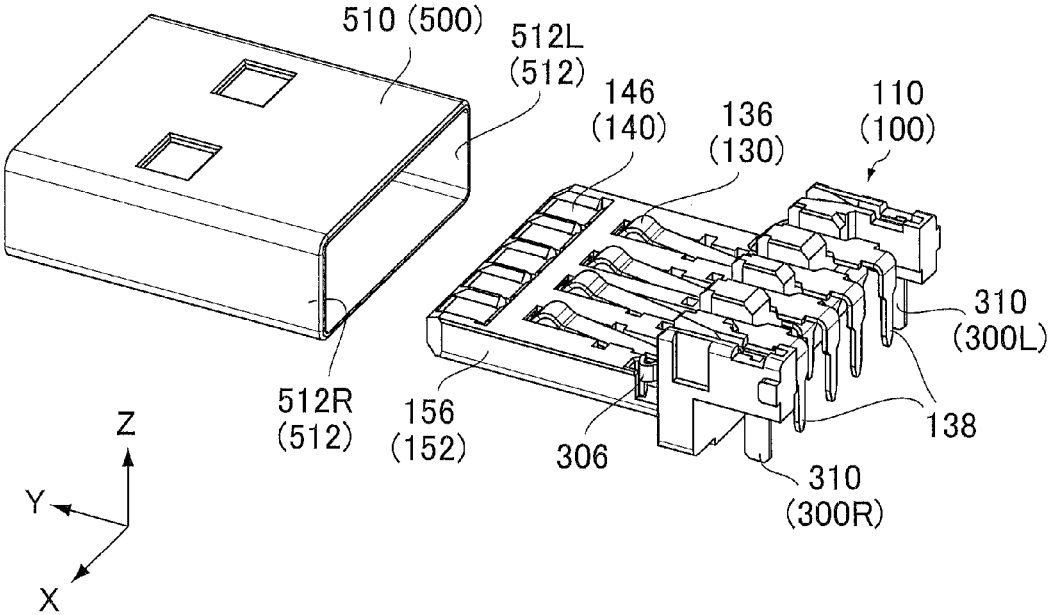
FIG. 22 is a perspective view showing the USB receptacle and the special shell of the special USB plug of FIG. 21, wherein the USB receptacle and the special USB plug are in the unmated state.

As shown in FIGS. 19 and 20, the USB receptacle 100 is mateable with a special USB plug 500 along a predetermined direction (Y-direction). Moreover, the USB receptacle 100 is mateable with each of a standard USB plug 400 (see FIG. 6) and a special USB plug 500' (see FIG. 8) along the Y-direction. In other words, the USB receptacle 100 is selectively mateable with and removable from the standard USB plug 400 or at least one kind of special USB plug (the special USB plug 500 or the special USB plug 500') along the Y-direction.

As described later, the USB receptacle 100 according to the present embodiment is detectable whether a mated USB plug (i.e. mating plug) is the special USB plug or the standard USB plug 400 (see FIG. 6). In other words, the USB receptacle 100 is provided with a detecting structure to identify the kind of the mating plug. Hereafter, firstly, explanation is made about structure of each of the standard USB plug 400, the special USB plug 500 (see FIG. 7) and the special USB plug 500' (see FIG. 8) each of which is mateable with the USB receptacle 100. Subsequently, explanation is made about structure of the USB receptacle 100.

Figure 6:
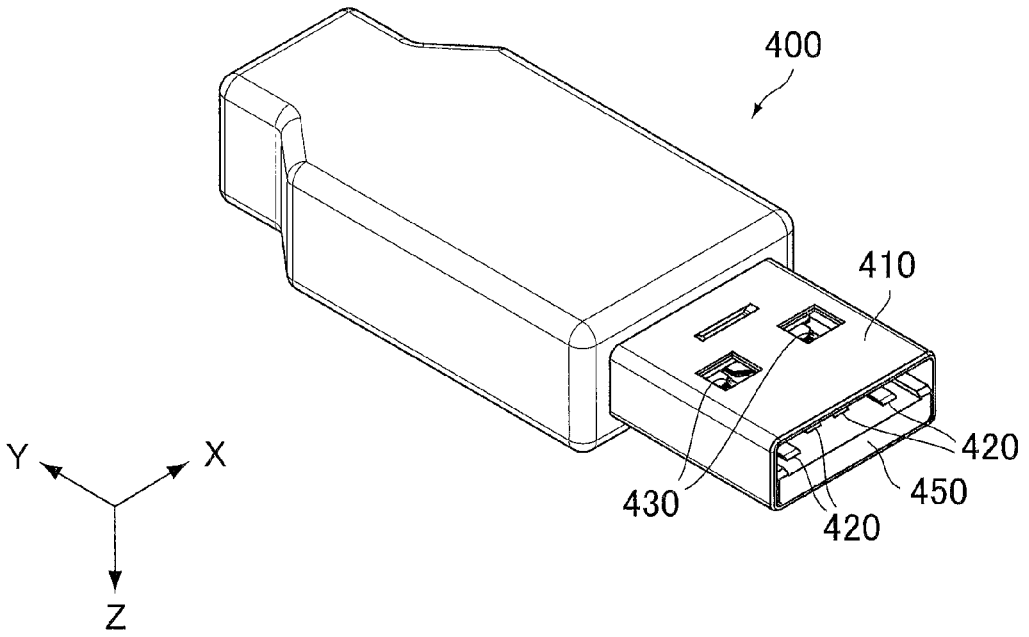
FIG. 6 is a perspective view showing a standard USB plug which is mateable with the USB receptacle of FIG. 2.

As shown in FIG. 6, the standard USB plug 400 is a USB plug compliant with a USB 3.0 standard which is one of USB standard. The standard USB plug 400 comprises a standard shell 410 (mating shell) made of a conductive material such as a metal, a plurality of standard contacts 420 each made of a conductive material, a plurality of standard contacts 430 each made of a conductive material and a standard holding member 450 made of an insulating material. Each of the standard shell 410 and the standard holding member 450 has a shape and a size compliant with the USB 3.0 standard. The standard contacts 420 are contacts for USB 2.0 connection while the standard contacts 430 are contacts for USB 3.0 connection. The standard holding member 450 holds the standard contacts 420 and the standard contacts 430. The standard shell 410 covers the standard holding member 450.

Figure 7:
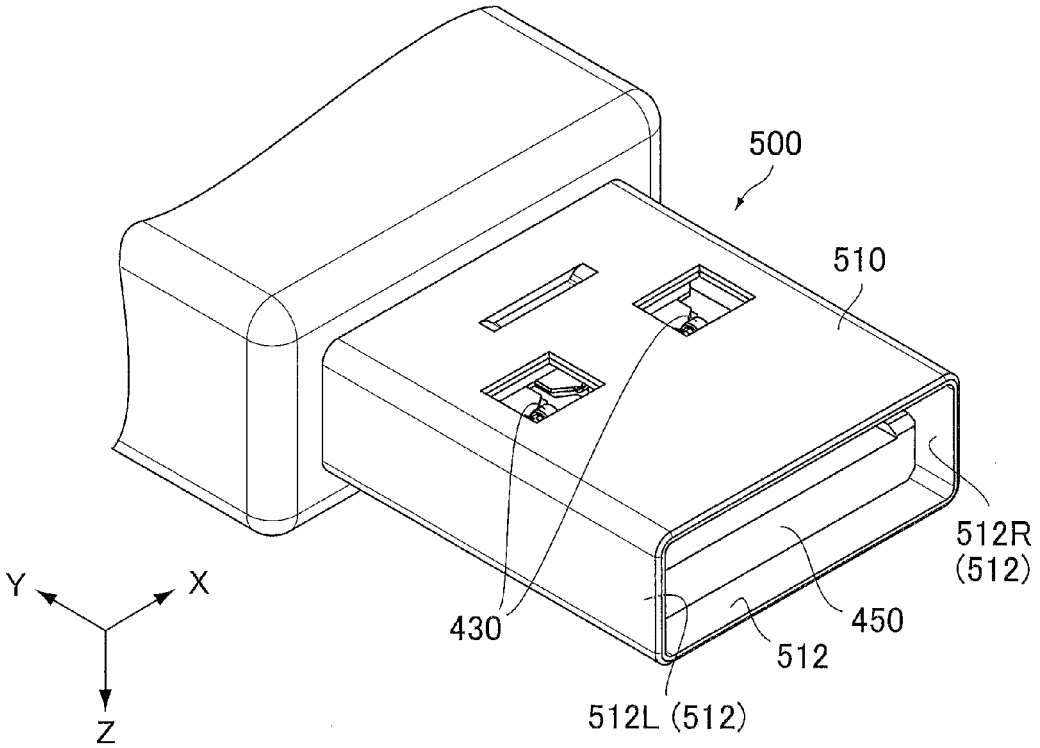
FIG. 7 is a perspective view showing the vicinity of a special shell of a special USB plug which is mateable with the USB receptacle of FIG. 2.

Referring to FIGS. 6 and 7, the special USB plug 500 according to the present embodiment has a structure similar to, but a little different from, that of the standard USB plug 400. The special USB plug 500 comprises a special shell 510 (mating shell) made of a conductive material such as a metal, a plurality of the standard contacts 420 (see FIG. 6), a plurality of the standard contacts 430 and the standard holding member 450. The special shell 510 covers the standard holding member 450.

The special shell 510 has a size different from that of the standard shell 410 in the Y-direction. In detail, the special shell 510 has an identifiable portion 512 which is not included in the standard shell 410. The special shell 510 according to the present embodiment, except for the identifiable portion 512, has a shape and a size same as those of the standard shell 410. In other words, the special shell 510 includes a predetermined section having the shape and the size same as those of the standard shell 410. The identifiable portion 512 projects beyond the predetermined section, or a section corresponding to the standard shell 410, in the negative Y-direction. Accordingly, in the Y-direction, a size of whole of the special shell 510 is larger than a size of the standard shell 410 by a size of the identifiable portion 512.

As shown in FIG. 7, the identifiable portion 512 according to the present embodiment has a square ring shape. In detail, the identifiable portion 512 includes two kinds of identifiable portions, namely, a first identifiable portion (identifiable portion) 512R and a second identifiable portion (identifiable portion) 512L. The first identifiable portion 512R and the second identifiable portion 512L are located at opposite ends of the identifiable portion 512 in the X-direction (pitch direction), respectively. The first identifiable portion 512R and the second identifiable portion 512L are coupled with each other in a plane perpendicular to the Y-direction.

Figure 2:
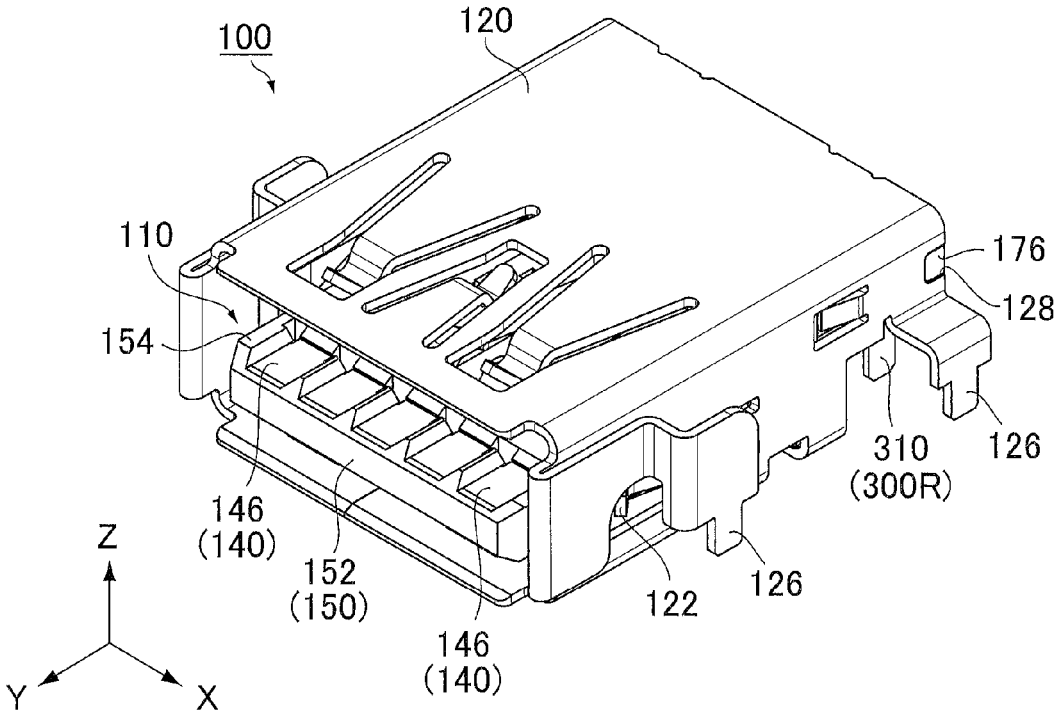
FIG. 2 is a perspective view showing the USB receptacle of FIG. 1.
Figure 3:
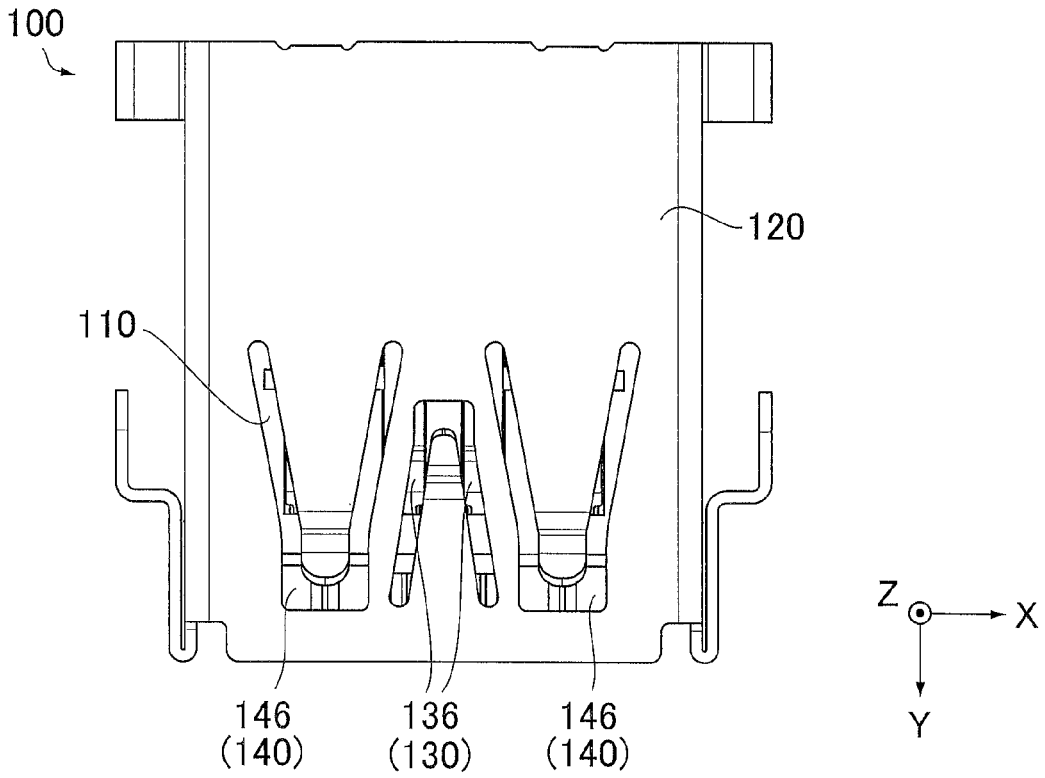
FIG. 3 is a top view showing the USB receptacle of FIG. 2.
Figure 8:
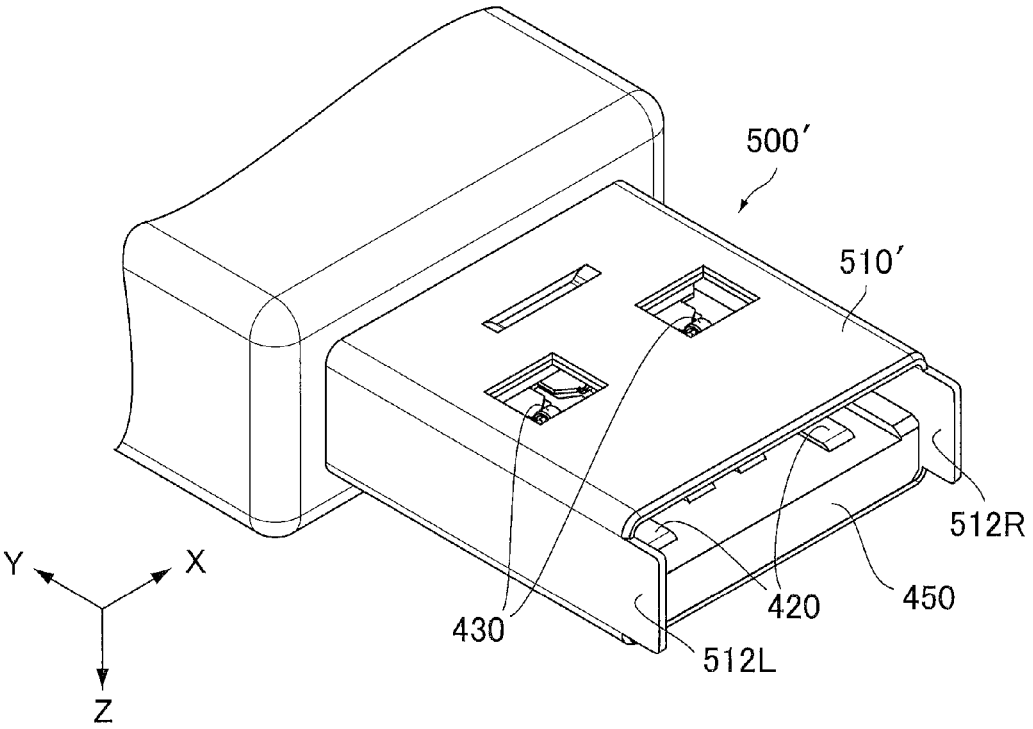
FIG. 8 is a perspective view showing a modification of the special USB plug of FIG. 7.

Referring to FIGS. 7 and 8, the special USB plug 500' (see FIG. 8) is formed by modifying only the identifiable portion 512 of the special shell 510 of the special USB plug 500 (see FIG. 7). In detail, the special USB plug 500' has a special shell 510' (mating shell). Similar to the special shell 510, the special shell 510' has the first identifiable portion 512R and the second identifiable portion 512L. However, the special shell 510' does not have a portion which couples the first identifiable portion 512R with the second identifiable portion 512L in the plane perpendicular to the Y-direction. The special USB plug 500' is the same kind of the special USB plug as the special USB plug 500 with respect to the detecting structure of the USB receptacle 100 (FIG. 2). The USB receptacle 100 according to the present embodiment can identify two kinds of USB plugs, namely, the standard USB plug 400 and one kind of the special USB plug.

The special shell 510' of the special USB plug 500' can be further modified. For example, a second special USB plug (not shown) or a third special USB plug (not shown) can be formed, wherein the second special USB plug has only the first identifiable portion 512R of the special shell 510', and the third special USB plug has only the second identifiable portion 512L of the special shell 510'.

As described above, the special USB plug 500 and the special USB plug 500' comprise structures same as each other with respect to the detecting structure of the USB receptacle 100 (FIG. 2). The following explanation about the special USB plug 500 is also relevant to the special USB plug 500'. Accordingly, hereafter, the special USB plug 500' is not referred explicitly.

As shown in FIGS. 1 to 4, the USB receptacle 100 according to the present embodiment comprises a connector body 110 and a shell 120 made of a conductive material. The shell 120 encloses the connector body 110 in the plane (XZ-plane) perpendicular to the Y-direction.

The shell 120 according to the present embodiment roughly has a rectangular cube-like shape. In detail, the shell 120 has a roughly rectangular cross-section in the plane perpendicular to the Y-direction. The rectangular cross-section of the shell 120 is long in the X-direction while short in the Z-direction (vertical direction).

Figure 4:
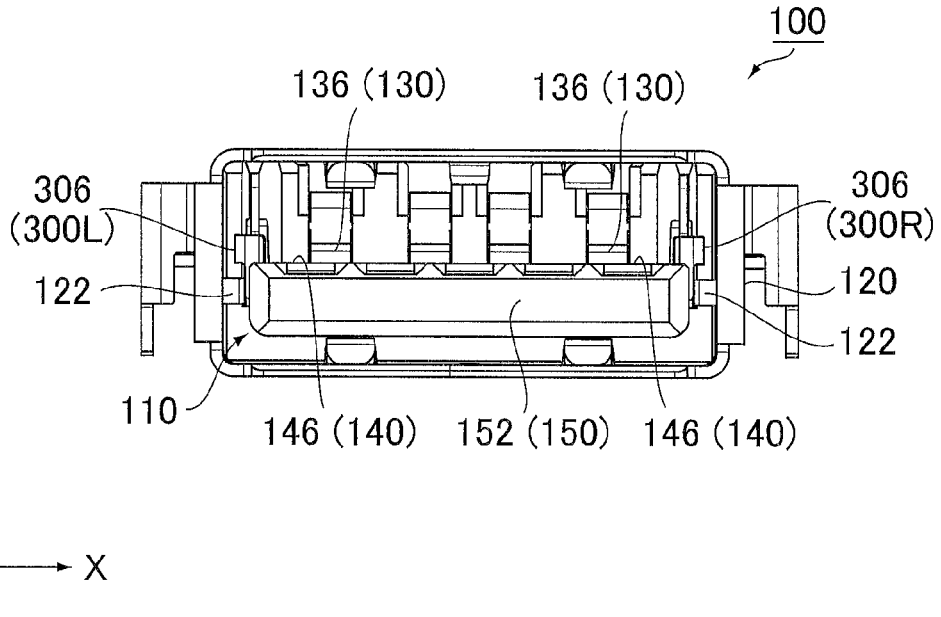
FIG. 4 is a front view showing the USB receptacle of FIG. 2.
Figure 5:
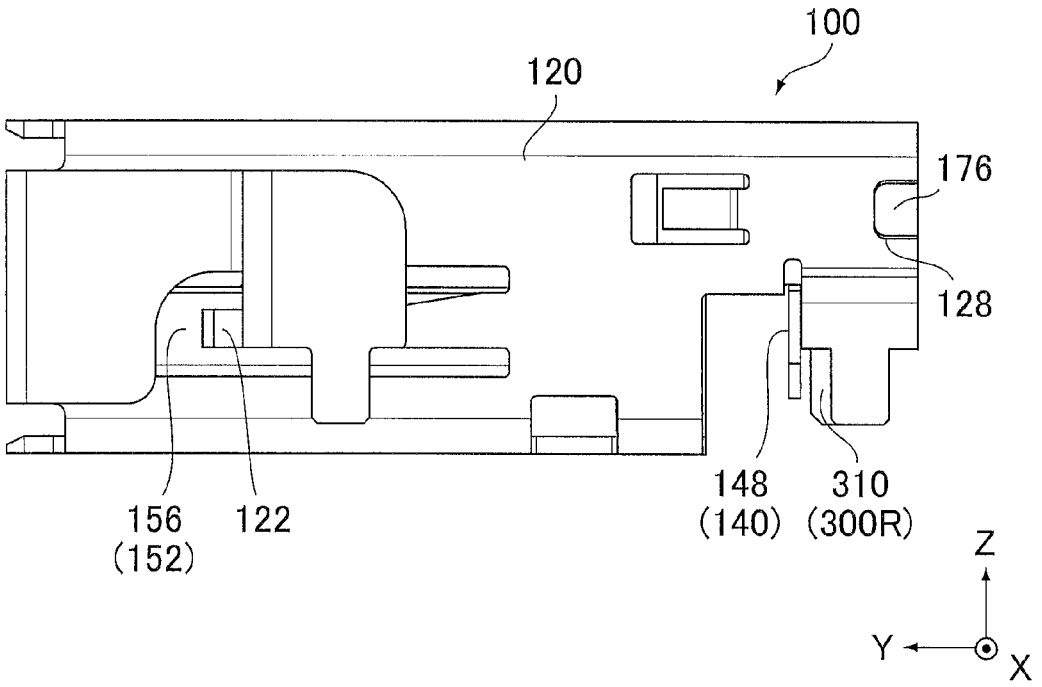
FIG. 5 is a side view showing the USB receptacle of FIG. 2.

As shown in FIGS. 2, 4 and 5, the shell 120 is formed with shell connection portions 122 on opposite side surfaces thereof in the X-direction, respectively. The shell connection portions 122 are connected to the special shell 510 (see FIG. 20) when the USB receptacle 100 is mated with the special USB plug 500. Moreover, the shell connection portions 122 are connected to the standard shell 410 (see FIG. 6) when the USB receptacle 100 is mated with the standard USB plug 400. In other words, when the USB receptacle 100 is mated with the standard USB plug 400 or the special USB plug 500, the shell 120 is electrically connected with the standard shell 410 or the special shell 510.

As can be seen from FIGS. 1 and 2, the shell 120 is formed with two fixed portions 126 at opposite side thereof in the X-direction, respectively. When the USB receptacle 100 is attached to the circuit board 800, the fixed portions 126 are inserted into holes formed in the circuit board 800 to be connected to conductive traces (not shown).

As can be seen from FIGS. 2 to 5, the shell 120 is provided with two attached portions 128. The attached portions 128 are formed at rear ends (negative Y-side ends) of the opposite side surfaces of the shell 120, respectively. The attached portion 128 is a notch which is cut forward (along the positive Y-direction). In other words, the attached portion 128 is recessed forward.

Figure 9:
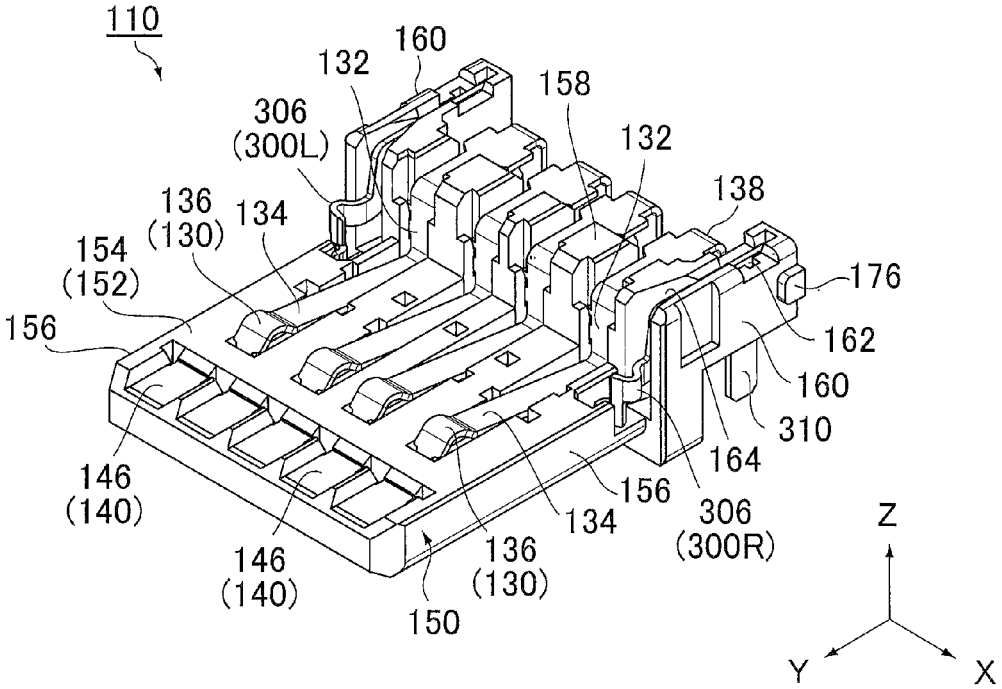
FIG. 9 is a perspective view showing a connector body of the USB receptacle of FIG. 2.
Figure 10:
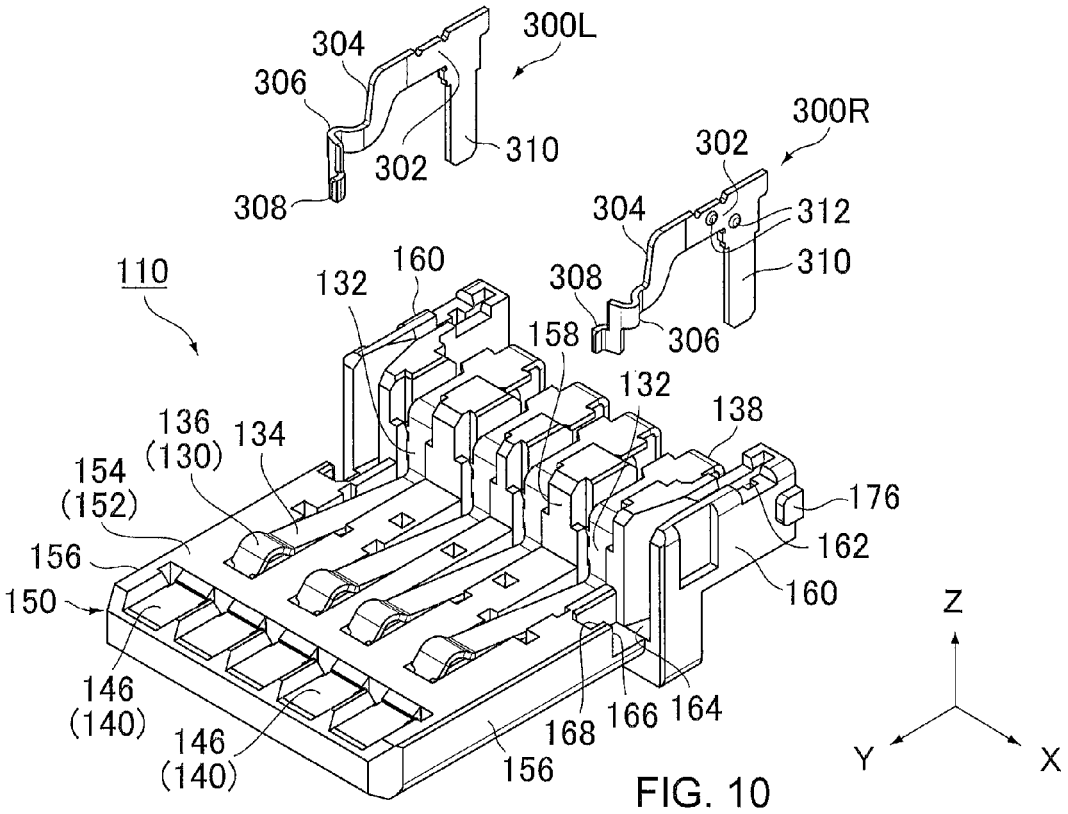
FIG. 10 is a perspective view showing the connector body of FIG. 9, wherein a first detector and a second detector are detached from the connector body.
Figure 11:
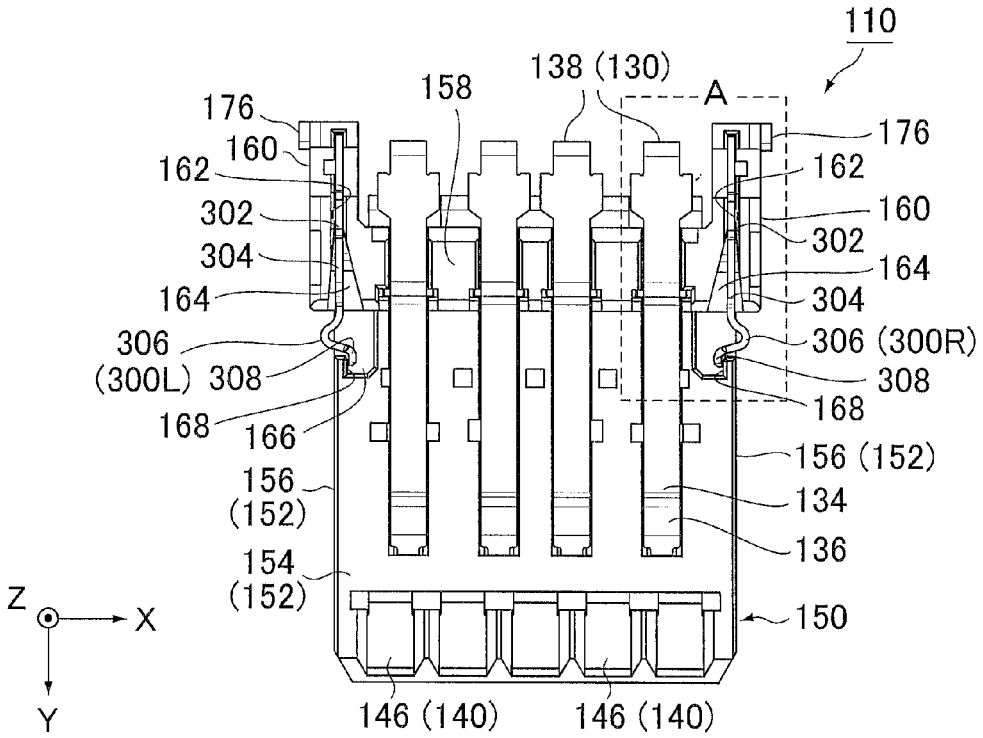
FIG. 11 is a top view showing the connector body of FIG. 9.

As shown in FIGS. 9 to 11, the connector body 110 of the USB receptacle 100 comprises a plurality of contacts 130 each made of a conductive material, a plurality of contacts 140 each made of a conductive material, a holding member 150 made of an insulating material such as a resin, a first detector (detector) 300R made of a conductive material and a second detector (detector) 300L made of a conductive material. The holding member 150 holds the contacts 130 and arranges the contacts 130 in the X-direction. Moreover, the holding member 150 holds the contacts 140 and arranges the contacts 140 in the X-direction. Each of the first detector 300R and the second detector 300L is formed separately from the shell 120 (see FIG. 4). In other words, each of the first detector 300R and the second detector 300L is other than the shell 120 and is distinct from the shell 120.

The contacts 130 are contacts for USB 2.0 connection while the contacts 140 are contacts for USB 3.0 connection. According to the present embodiment, the number of the contacts 130 is four while the number of the contacts 140 is five. Each of the contacts 130 has a held portion 132, a spring portion 134, a contact part 136 and a fixed portion 138. The held portion 132 is held by the holding member 150. The spring portion 134 extends forward from the held portion 132 while sloping upward (in the positive Z-direction). The contact part 136 is provided at an end of the spring portion 134. Each of the contacts 140 has a contact part 146 and a fixed portion 148 (see FIG. 15). The fixed portion 138 and the fixed portion 148 are connected to conductive traces (not shown) of the circuit board 800 (see FIG. 1) when the USB receptacle 100 is attached to the circuit board 800.

The holding member 150 has a body portion 152 and a contact holder 158. The body portion 152 has a plate-like shape which extends in the Y-direction while having a thickness in the Z-direction. The body portion 152 has an upper surface 154 and two side surfaces 156. The side surfaces 156 are located at opposite sides of the body portion 152 in the X-direction, respectively. The contact holder 158 is located toward a rear side (negative Y-side) of the body portion 152. The contact holder 158 has two side portions 160. The side portions 160 are located at opposite sides of the contact holder 158 in the X-direction, respectively.

The held portions 132 of the contacts 130 are press-fit in the contact holder 158 of the holding member 150 to extend downward (along the negative Z-direction). The contact parts 136 are arranged on the upper surface 154 of the body portion 152 so as to partially project. The spring portions 134 of the contacts 130 are resiliently deformable so that the contact parts 136 are movable mainly in the Z-direction.

Referring to FIGS. 9 to 11, the contacts 140 are insert-molded into the holding member 150 when the holding member 150 is formed. The contacts 140 are partially embedded in the holding member 150. The contact parts 146 of the contacts 140 are arranged on the upper surface 154 of the body portion 152. The contact part 146 of the contact 140 is located at a position nearer to a front end (positive Y-side end) of the body portion 152 in comparison with the contact part 136 of the contact 130. In other words, the contact part 146 of the contact 140 is located between the contact part 136 of the contact 130 and the front end of the body portion 152 in the Y-direction.

Figure 12:
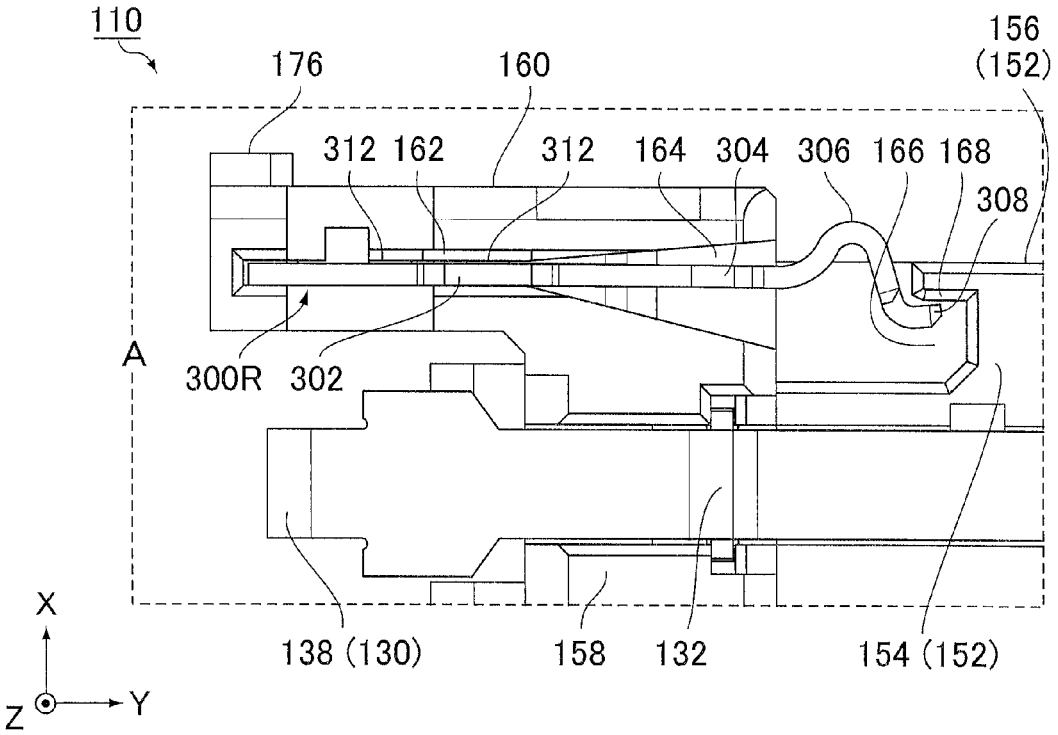
FIG. 12 is a top view showing the vicinity (the part enclosed by dashed line A in FIG. 11) of the first detector of the connector body of FIG. 11.

As shown in FIGS. 11 and 12, each of the side portions 160 of the contact holder 158 is formed with a detector holder 162, a deformation allowance region 164, a movement allowance region 166, a regulation portion 168 and an attaching portion 176.

The detector holder 162 is a ditch which extends in a direction perpendicular to the X-direction. In detail, the detector holder 162 partially pierces the side portion 160 in the Z-direction while extending in a vertical plane (YZ-plane) perpendicular to the X-direction. A part of the detector holder 162 extends to a bottom surface of the holding member 150.

Each of the deformation allowance region 164 and the movement allowance region 166 is a recess recessed downward (in the negative Z-direction). The deformation allowance region 164 is located forward of the detector holder 162. In detail, the deformation allowance region 164 extends in the positive Y-direction from the detector holder 162. The movement allowance region 166 is located forward of the deformation allowance region 164. In other words, the deformation allowance region 164 is located between the detector holder 162 and the movement allowance region 166 in the Y-direction. The regulation portion 168 is a wall slightly extending in the Y-direction. The regulation portion 168 is located outward of the movement allowance region 166 in the X-direction.

A size of the deformation allowance region 164 in the X-direction increases toward the movement allowance region 166 from the detector holder 162. In detail, the deformation allowance region 164 according to the present embodiment is defined by two walls. These two walls extend in the positive Y-direction while being away from each other in the X-direction. The thus-configured deformation allowance region 164 hardly degrades strength of the holding member 150 (especially, strength of the side portion 160).

As shown in FIG. 12, the movement allowance region 166 is located between the regulation portion 168 and the body portion 152 in the X-direction. The movement allowance region 166 has an inside edge in the X-direction, wherein the inside edge is located inward beyond the deformation allowance region 164 in the X-direction.

As shown in FIG. 9, the attaching portion 176 is located at a rear end of the side portion 160. The attaching portion 176 has a plate-like shape extending forward. The attaching portion 176 protrudes outward in the X-direction from the side portion 160. The attached portion 128 of the shell 120 is fitted with the attaching portion 176 rearward (along the negative Y-direction) so that the shell 120 is attached to the holding member 150.

As shown in FIG. 10, the first detector 300R and the second detector 300L have shapes which are mirror images to each other with respect to a plane perpendicular to the X-direction. Accordingly, the second detector 300L has a structure similar to the below mentioned structure of the first detector 300R.

Figure 16:
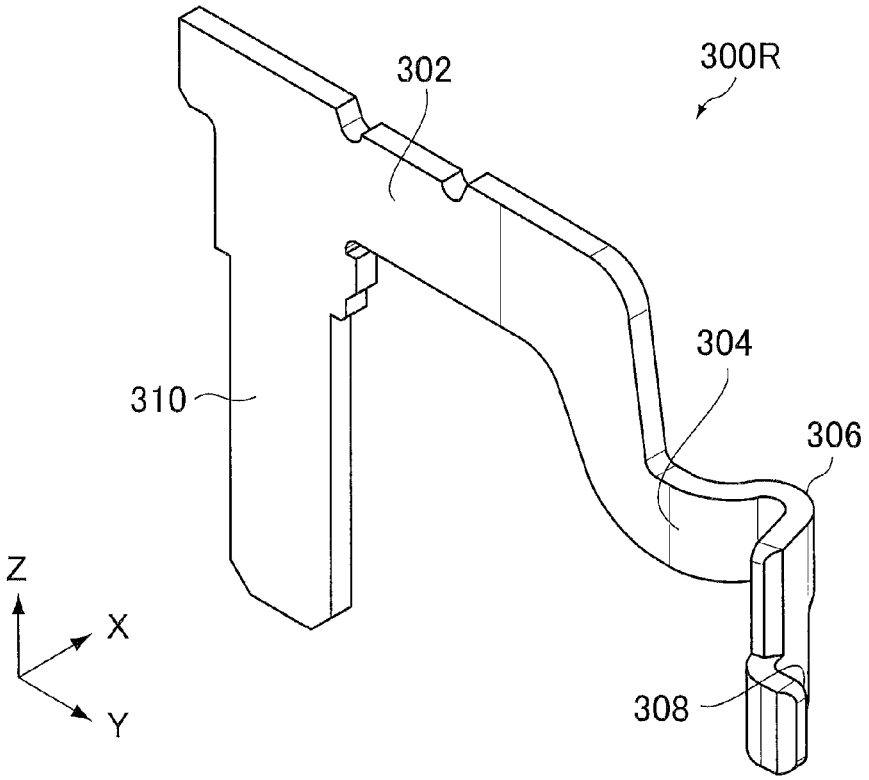
FIG. 16 is a perspective view showing the first detector of the connector body of FIG. 9.
Figure 17:
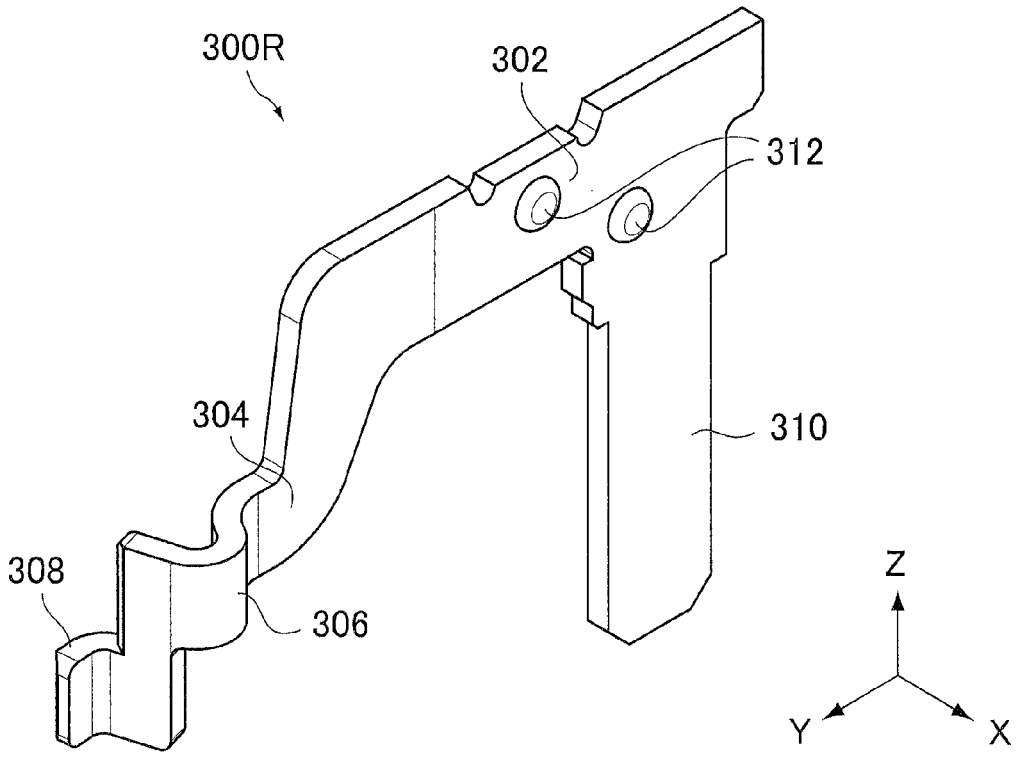
FIG. 17 is another perspective view showing the first detector of FIG. 16.
Figure 18:
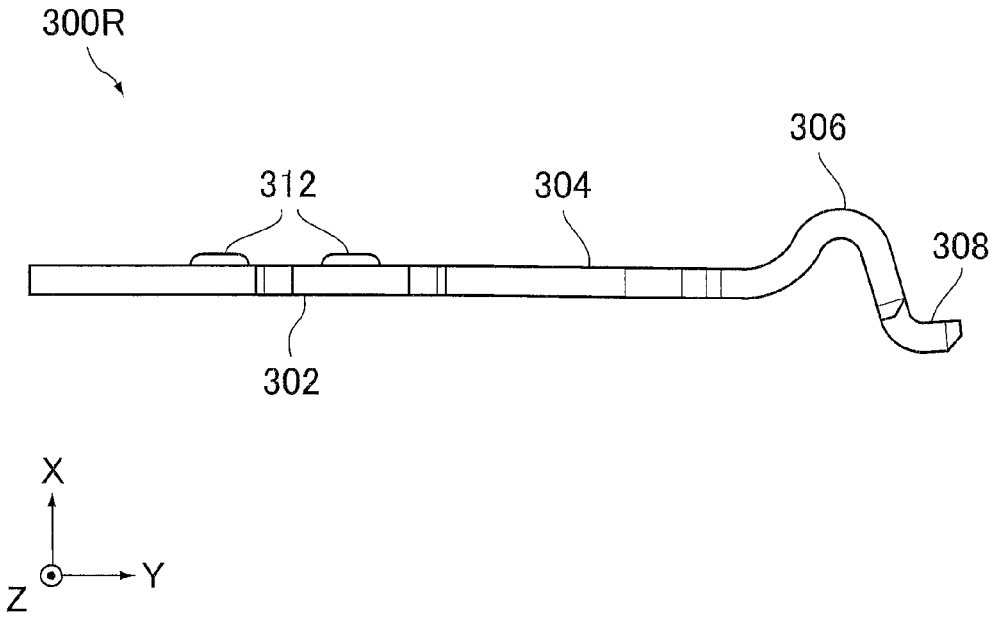
FIG. 18 is a top view showing the first detector of FIG. 16.

As shown in FIGS. 16 to 18, the first detector 300R has a held portion 302, a spring portion 304, a contact portion 306, a regulated portion 308 and a press-fit post 310. The held portion 302 has a flat plate-like shape. The held portion 302 is provided with two protrusions 312. The protrusions 312 are formed on an outside surface of the held portion 302 in the X-direction. The spring portion 304 extends forward from the held portion 302 while sloping downward as a whole. The contact portion 306 is provided on an end of the spring portion 304. The spring portion 304 is resiliently deformable in the X-direction. The contact portion 306 is movable mainly in the X-direction by the resilient deformation of the spring portion 304. The regulated portion 308 is located below the contact portion 306. The regulated portion 308 and the contact portion 306 are coupled with each other by a section extending in the Z-direction. The press-fit post 310 extends downward from the held portion 302. One of the protrusions 312 is located at a boundary between the held portion 302 and the press-fit post 310. The press-fit post 310 is connected to a conductive trace (not shown) of the circuit board 800 (see FIG. 1) when the USB receptacle 100 is attached to the circuit board 800.

As can be seen from FIGS. 16 to 18, the held portion 302, the spring portion 304 and the press-fit post 310 extend in a common vertical plane (YZ-plane). In other words, the held portion 302, the spring portion 304 and the press-fit post 310 form a common plane. However, the contact portion 306 and the regulated portion 308 are not located in the plane including the spring portion 304. Thus, the first detector 300R is formed to have minimum curves. Each of the held portion 302, the spring portion 304 and the press-fit post 310 according to the present embodiment has a thickness, or a size in the X-direction, smaller than a width of the ditch of the detector holder 162 (see FIG. 12). The contact portion 306 according to the present embodiment has a curved surface which protrudes from the common plane including the spring portion 304. In a plane (in the XY-plane) defined by the X-direction and the Y-direction, the curved surface of the contact portion 306 protrudes outward in the X-direction.

As shown in FIGS. 9 to 12, the first detector 300R is held by the side portion 160 located at the positive X-side while the second detector 300L is held by the side portion 160 located at the negative X-side. In detail, the press-fit posts 310 of the first detector 300R and the second detector 300L are inserted or press-fit into the detector holders 162 from above along the negative Z-direction, respectively, so that the held portions 302 are held in the detector holders 162, respectively.

As can be seen from FIGS. 10 to 12, when the press-fit post 310 is press-fit into the detector holder 162, the protrusions 312 are pressed against an inner wall of the detector holder 162. Accordingly, the protrusions 312 press the held portion 302 against the inner wall of the detector holder 162. According to the present embodiment, because a fixed end of the spring portion 304 of each of the first detector 300R and the second detector 300L is distinct, a designed spring force can be obtained. Especially, the protrusions 312 according to the present embodiment are formed in the vicinity of the press-fit post 310. Accordingly, the first detector 300R and the second detector 300L are positioned in the X-direction by the protrusions 312 almost simultaneously when the first detector 300R and the second detector 300L are press-fit into the detector holders 162, respectively. The held portion 302 can be therefore securely fixed to the inner wall of the detector holder 162.

As can be seen from FIG. 4, the first detector 300R and the second detector 300L held by the side portions 160 are not in contact with the shell 120. In other words, the first detector 300R and the second detector 300L are held by the side portions 160 of the holding member 150 not to be directly connected to the shell 120.

As shown in FIG. 12, when the first detector 300R and the second detector 300L are held by the side portions 160, respectively, the spring portion 304 is located in the deformation allowance region 164. Accordingly, the spring portion 304 is resiliently deformable in the deformation allowance region 164. In other words, the deformation allowance region 164 allows resilient deformation of the spring portion 304.

As can be seen from FIGS. 9 and 10, when the first detector 300R and the second detector 300L are held by the side portions 160, respectively, the spring portion 304 extends from the held portion 302 in a direction defined by the positive Y-direction and the negative Z-direction. In other words, the spring portion 304 extends in a direction oblique to both the Z-direction and the Y-direction. Accordingly, the spring portion 304 can be made to extend long. Moreover, the deformation allowance region 164 is formed to increase in size in the X-direction as it approaches the contact portion 306 away from the held portion 302 in the Y-direction. The spring portion 304 placed in the thus-configured deformation allowance region 164 can be resiliently deformed sufficiently in the X-direction.

As shown in FIGS. 11 and 12, when the first detector 300R and the second detector 300L are held by the side portions 160, respectively, the contact portion 306 is movable in a horizontal plane (in the XY-plane) perpendicular to the Z-direction. Moreover, the contact portion 306 protrudes outward in the X-direction from the side surface 156 of the body portion 152. As shown in FIG. 4, when the USB receptacle 100 is seen from a mating end (from the front) thereof, the contact portion 306 is visible.

Figure 13:
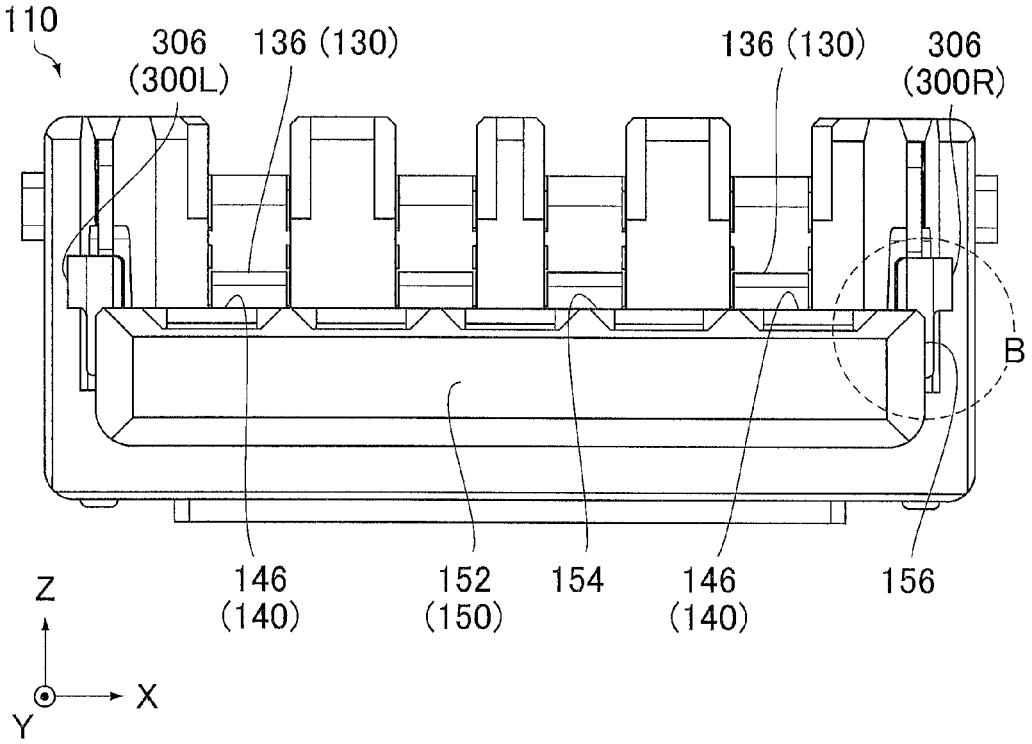
FIG. 13 is a front view showing the connector body of FIG. 9.
Figure 14:
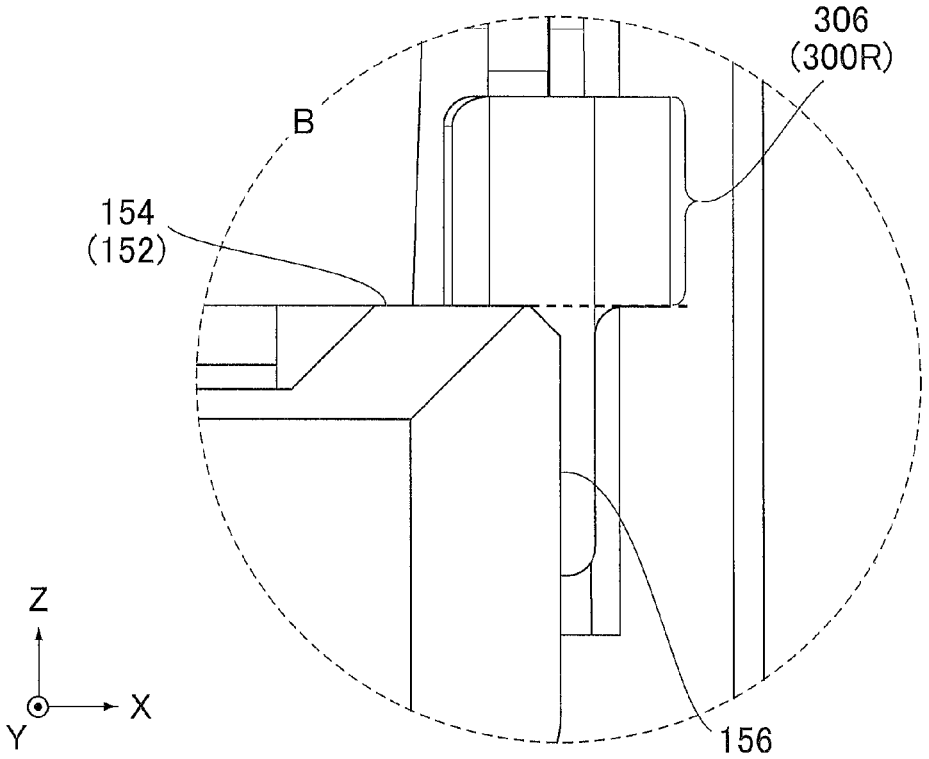
FIG. 14 is a front view showing the vicinity (the part enclosed by dashed line B in FIG. 13) of the first detector of the connector body of FIG. 13.
Figure 15:
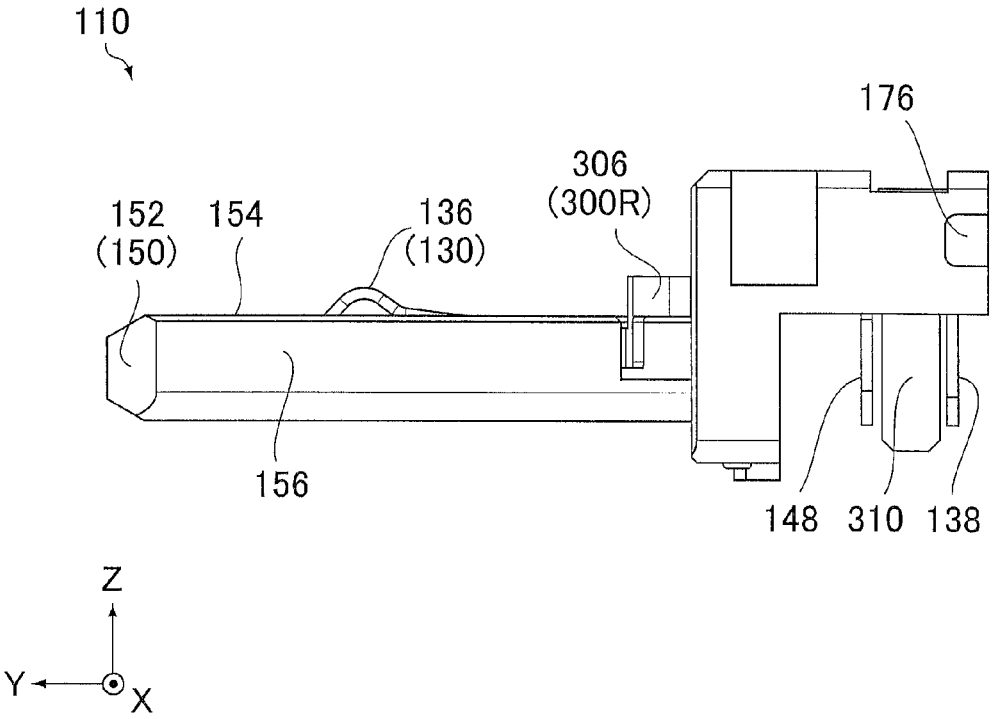
FIG. 15 is a side view showing the connector body of FIG. 9.

As shown in FIGS. 13 to 15, the contact portion 306 does not overlap the body portion 152 at all in the Z-direction. Especially, the contact portion 306 according to the present embodiment does not overlap the side surface 156 of the body portion 152 at all in the Z-direction. In other words, when the contact portion 306 and the body portion 152 are projected in a plane in parallel to the Z-direction along any direction perpendicular to the Z-direction, the projected image of the contact portion 306 does not overlap the projected image of the body portion 152. According to the present embodiment, a lower end (negative Z-side end) of the contact portion 306 is located slightly above the upper surface 154 of the body portion 152 in the Z-direction. In other words, the contact portion 306 is located slightly above the body portion 152. However, the contact portion 306 may be located a larger distance apart from the body portion 152 in the Z-direction.

As shown in FIGS. 11 and 12, when the first detector 300R and the second detector 300L are held by the side portions 160, respectively, the regulated portion 308 is located in the movement allowance region 166. The regulated portion 308 is movable in the movement allowance region 166 when the spring portion 304 is resiliently deformed. In other words, the movement allowance region 166 allows a movement of the regulated portion 308 in the horizontal plane.

The regulation portion 168 regulates an outward movement of the regulated portion 308 in the X-direction. In detail, the regulation portion 168 is located between the regulated portion 308 and the contact portion 306 in the X-direction. In other words, the regulation portion 168 is located outward of the regulated portion 308 in the X-direction. Accordingly, even when an outward force in the X-direction is applied to the contact portion 306, the regulated portion 308 is brought into abutment with the regulation portion 168 so that the contact portion 306 is prevented from being moved excessively. The regulation portion 168 has an outside surface in the X-direction. According to the present embodiment, the outside surface of the regulation portion 168 and the side surface 156 of the body portion 152 are formed to be flush with each other. However, the outside surface of the regulation portion 168 may be located inward of the side surface 156 of the body portion 152 in the X-direction.

Referring to FIGS. 4 and 12, the regulated portion 308 is located within a space inward of the regulation portion 168, or within the movement allowance region 166 which is recessed downward from the upper surface 154 of the body portion 152. Accordingly, when the USB receptacle 100 is seen from the mating end, the regulated portion 308 is invisible. According to the present embodiment, the regulated portion 308 can be prevented from being brought into contact with some members or portions inserted along the negative Y-direction.

As shown in FIGS. 19 to 26, when the special USB plug 500 is mated with the USB receptacle 100 along the negative Y-direction, the first identifiable portion 512R and the second identifiable portion 512L of the special shell 510 are brought into contact with the contact portions 306 of the first detector 300R and the second detector 300L, respectively. In other words, the USB receptacle 100 according to the present embodiment comprises two kinds of the detectors, namely, the first detector 300R and the second detector 300L, which are connectable to the first identifiable portion 512R and the second identifiable portion 512L, respectively.

Figure 23:
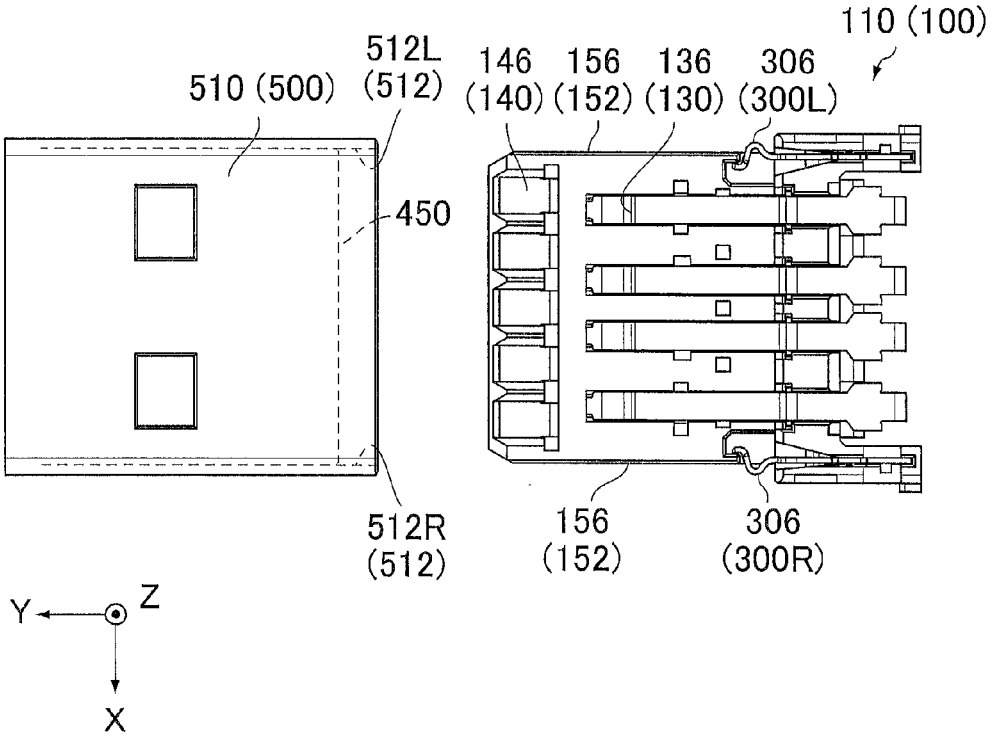
FIG. 23 is a top view showing the USB receptacle and the special shell of the special USB plug of FIG. 22, wherein an outline of a standard holding member and an outline of a side surface of the identifiable portion, which are covered by the special shell, are illustrated by dashed line.
Figure 24:
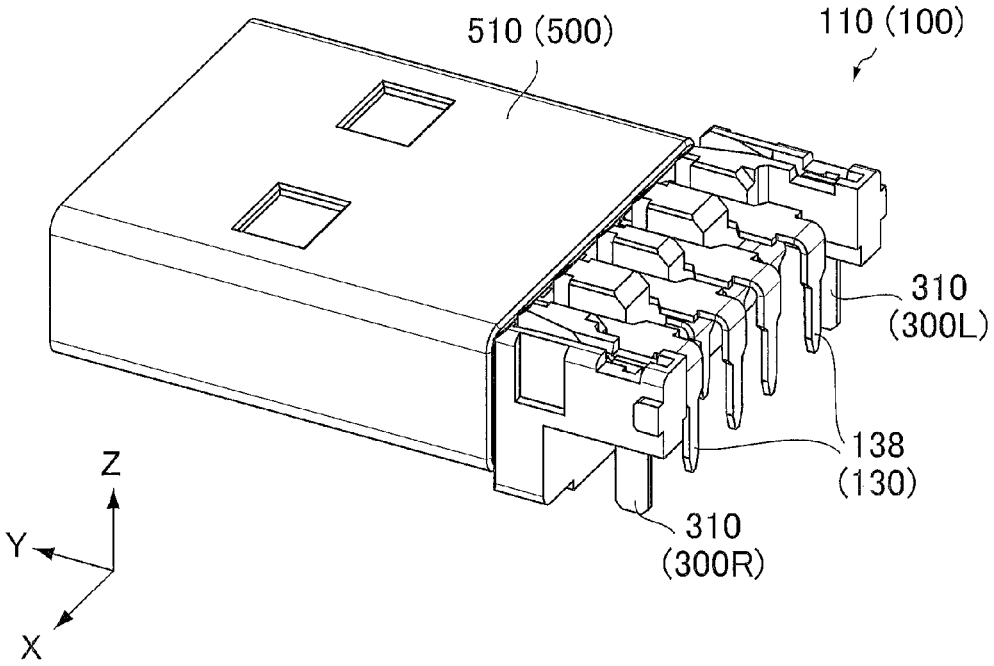
FIG. 24 is a perspective view showing the USB receptacle and the special shell of the special USB plug of FIG. 21.
Figure 25:
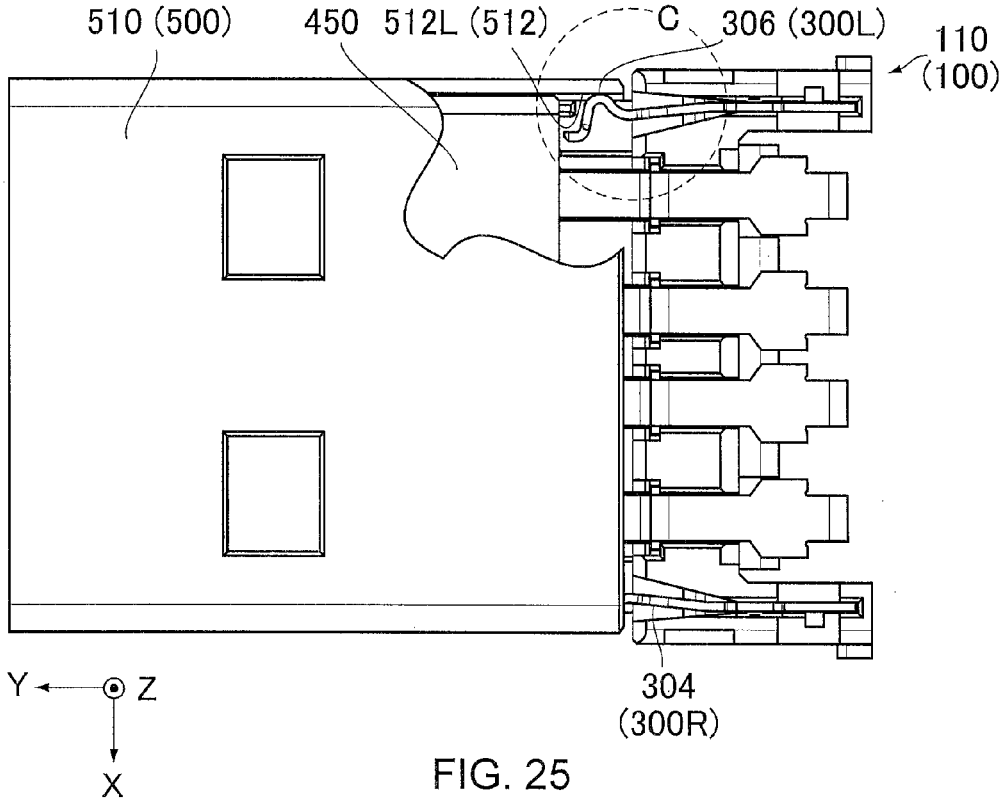
FIG. 25 is a top view showing the USB receptacle and the special shell of the special USB plug of FIG. 24, wherein a part of the special shell is not illustrated.
Figure 26:
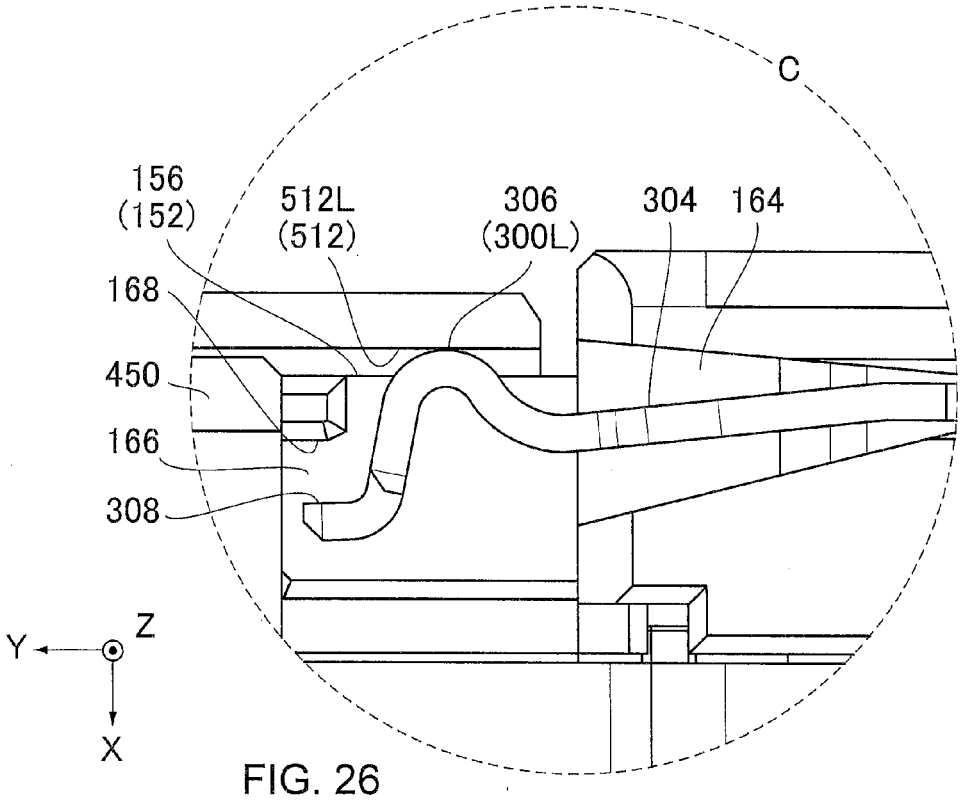
FIG. 26 is a top view showing the vicinity (the part enclosed by dashed line C in FIG. 25) of the second detector of the USB receptacle of FIG. 25.
Figure 27:
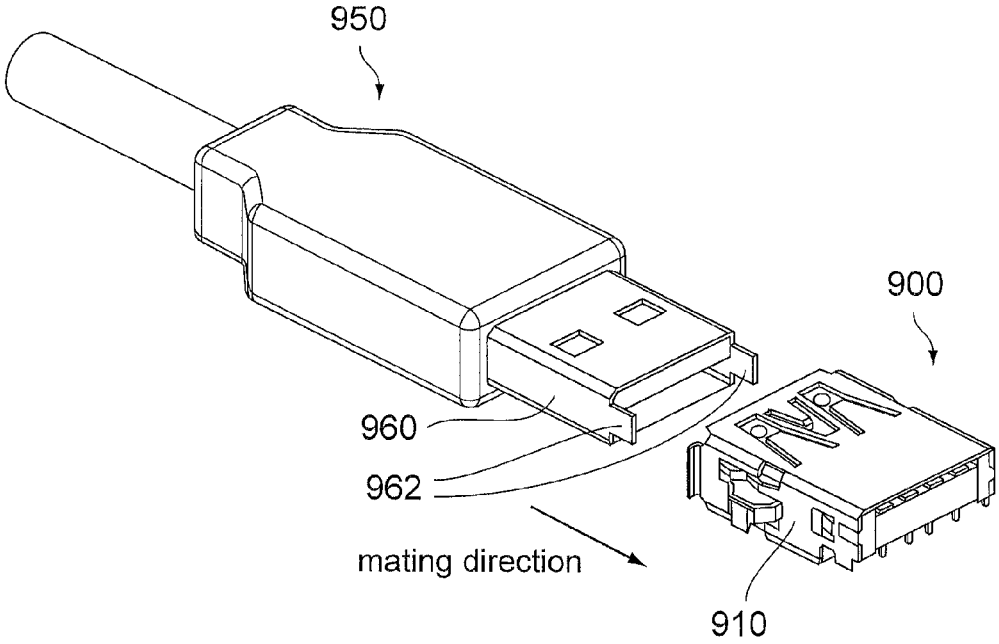
FIG. 27 PRIOR ART
FIG. 27 is a perspective view showing a USB receptacle and a special USB plug of Patent Document 1, wherein the USB receptacle and the special USB plug are in an unmated state.
Figure 28:
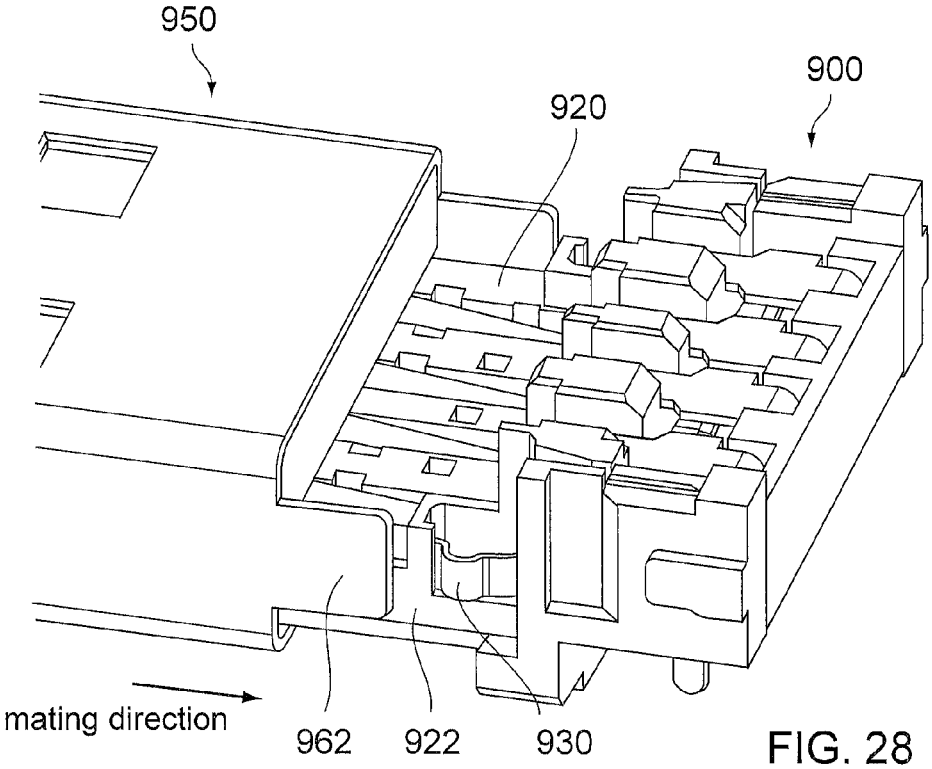
FIG. 28 PRIOR ART
FIG. 28 is a perspective view showing the USB receptacle and the special USB plug of FIG. 27, wherein the USB receptacle and the special USB plug are in middle of mating.

As can be seen from FIGS. 23, 25 and 26, under a mated state where the USB receptacle 100 is mated with the special USB plug 500, the regulation portion 168 is located inward of the special shell 510 in the X-direction. Moreover, under the mated state, the contact portion 306 is connected to an inside of the identifiable portion 512 of the special shell 510. Because the contact portion 306 is thus configured, a size of the USB receptacle 100 in the X-direction can be relatively small. Moreover, according to the present embodiment, a part of the curved surface of the contact portion 306 is brought into contact with the inside of the first identifiable portion 512R or the second identifiable portion 512L in the X-direction. Accordingly, contact point of the contact portion 306 is distinct.

As can be seen from FIG. 25, when the special USB plug 500 is mated with the USB receptacle 100, any part of the special shell 510, except the identifiable portion 512, is unreachable to the first detector 300R nor the second detector 300L in the Y-direction. Accordingly, when the standard USB plug 400 (see FIG. 6) is mated with the USB receptacle 100, the standard shell 410 is not brought into contact with the first detector 300R nor the second detector 300L. In other words, the contact portion 306 is arranged at a position where the standard shell 410 does not reach when the standard USB plug 400 is mated with the USB receptacle 100. In detail, each of the first detector 300R and the second detector 300L is held at a position where the standard shell 410 does not reach the contact portion 306 upon the mating of the USB receptacle 100 with the standard USB plug 400. Moreover, each of the first detector 300R and the second detector 300L is held at a position where the identifiable portion 512 of the special shell 510 is connected to the contact portions 306 upon the mating of the USB receptacle 100 with the special USB plug 500.

As can be seen from FIGS. 19 and 20, the shell 120 is connected to the standard shell 410 via the shell connection portion 122 when the USB receptacle 100 is mated with the standard USB plug 400 (see FIG. 6), and the shell 120 is connected to the special shell 510 via the shell connection portion 122 when the USB receptacle 100 is mated with the special USB plug 500. In other words, the shell 120 has a shape connectable to each of the standard shell 410 and the special shell 510. The first detector 300R and the second detector 300L are electrically unconnected with the shell 120 upon the mating of the USB receptacle 100 with the standard USB plug 400 while being electrically connected with the shell 120 upon the mating of the USB receptacle 100 with the special USB plug 500.

As can be seen from FIGS. 14 and 26, because the contact portion 306 is located above the body portion 152 in the Z-direction, a section, which is to be connected to the contact portion 306, of the identifiable portion 512 is located above the side surface 156 of the body portion 152. Accordingly, even if the identifiable portion 512 shaves the side surface 156 of the body portion 152 upon the mating of the USB receptacle 100 with the special USB plug 500 (see FIG. 22), the shavings hardly adhere to the contact portion 306. The first detector 300R and the second detector 300L can therefore keep preferable electrical connection with the first identifiable portion 512R and the second identifiable portion 512L of the special shell 510, respectively.

As can be seen from FIGS. 20 and 25, according to the present embodiment, it is possible to detect whether the USB receptacle 100 is mated with the standard USB plug 400 (see FIG. 6) or the special USB plug 500 by detecting whether the first detector 300R and the second detector 300L are electrically connected with the shell 120 or not. In other words, it is possible to identify the kind of the mating plug of the USB receptacle 100. More specifically, for example, it is possible to identify the kind of the mating plug by detecting an electric current. In this case, it may be detected whether an electric current flows or not between the shell 120 and each of the first detector 300R and the second detector 300L. Moreover, it is also possible to identify the kind of the mating plug by detecting electric potential. In this case, the electric potential of each of the first detector 300R and the second detector 300L may be pulled up while the shell 120 is connected to the ground. Then, it may be detected whether the electric potential of each of the first detector 300R and the second detector 300L is changed, or lowered to the ground potential, or not.

When the electric current or the electric potential is detected as described above, it is possible to perform a first detection for the first detector 300R and a second detection for the second detector 300L independently from each other. When the first detection and the second detection are performed independently, it is possible to identify not only the special USB plug 500 but also the second special USB plug having only the first identifiable portion 512R (not shown) and the third special USB plug having only the second identifiable portion 512L (not shown). In detail, when it is detected that the first detector 300R and the second detector 300L are both electrically connected with the shell 120, it can be considered that the special USB plug 500 is connected to the USB receptacle 100. When it is detected that only the second detector 300L is electrically connected with the shell 120, it can be considered that the third special USB plug is connected to the USB receptacle 100. When it is detected that only the first detector 300R is electrically connected with the shell 120, it can be considered that the second special USB plug is connected to the USB receptacle 100. When it is detected that neither the first detector 300R nor the second detector 300L is electrically connected with the shell 120, it can be considered that the standard USB plug 400 is connected to the USB receptacle 100.

The present application is based on a Japanese patent application of JP2013-175352 filed before the Japan Patent Office on Aug. 27, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A universal serial bus (USB) receptacle which is selectively mateable with and removable from a standard USB plug or at least one kind of special USB plug along a predetermined direction, wherein:

the standard USB plug is compliant with a USB standard and comprises a standard shell made of a conductive material;

the special USB plug has a structure different from a structure of the standard USB plug and comprises a special shell made of a conductive material;

the special shell includes a predetermined section and an identifiable portion, wherein the predetermined section has a shape same as a shape of the standard shell, and the identifiable portion projects beyond the predetermined section in the predetermined direction;

the USB receptacle comprises a plurality of contacts, a holding member made of an insulating material, a shell made of a conductive material and a detector made of a conductive material;

each of the contacts has a contact part;

the holding member holds the contacts and arranges the contacts in a pitch direction perpendicular to the predetermined direction;

the holding member has a body portion;

the body portion has a plate-like shape which extends in the predetermined direction while having a thickness in a vertical direction perpendicular to both the predetermined direction and the pitch direction;

the contact parts of the contacts are arranged on an upper surface of the body portion;

the shell encloses the holding member in a plane perpendicular to the predetermined direction;

the shell is connected to the standard shell when the USB receptacle is mated with the standard USB plug, and the shell is connected to the special shell when the USB receptacle is mated with the special USB plug;

the detector is other than the shell;

the detector is held by one of opposite side portions of the holding member not to be directly connected to the shell;

the detector has a contact portion;

the contact portion is arranged at a position where the standard shell does not reach when the USB receptacle is mated with the standard USB plug;

the contact portion is movable in a horizontal plane perpendicular to the vertical direction;

the contact portion does not overlap the body portion of the holding member at all in the vertical direction;

a lower end of the contact portion is located above the upper surface of the body portion in the vertical direction; and the contact portion is connected to an inside of the identifiable portion of the special shell in the pitch direction when the USB receptacle is mated with the special USB plug.

2. The USB receptacle as recited in claim 1, wherein:

the detector has a regulated portion;

the body portion of the holding member is formed with a regulation portion; and the regulation portion regulates, in the pitch direction, an outward movement of the regulated portion.

3. The USB receptacle as recited in claim 2, wherein:

the body portion of the holding member has a movement allowance region; and the movement allowance region allows a movement of the regulated portion in the horizontal plane.

4. The USB receptacle as recited in claim 1, wherein:

the detector has a held portion and a spring portion;

the spring portion extends from the held portion to be resiliently deformable;

the contact portion is provided on the spring portion;

the holding member has a detector holder; and the detector holder holds the held portion.

5. The USB receptacle as recited in claim 4, wherein:

the holding member has a deformation allowance region;

the deformation allowance region allows resilient deformation of the spring portion; and the deformation allowance region is formed to increase in size in the pitch direction as it approaches the contact portion of the detector from the held portion in the predetermined direction.

6. The USB receptacle as recited in claim 4, wherein:

the detector holder is a ditch which extends in a vertical plane perpendicular to the pitch direction; the held portion and the spring portion extend in the vertical plane;

in the pitch direction, a size of each of the held portion and the spring portion is smaller than another size of the detector holder;

the detector is formed with a protrusion; and the protrusion presses the held portion against an inside wall of the detector holder.

7. The USB receptacle as recited in claim 6, wherein:

the detector is formed with a press-fit post;

the press-fit post is press-fit in the holding member; and the protrusion is formed in the vicinity of the press-fit post.

8. The USB receptacle as recited in claim 4, wherein the spring portion extends in a direction oblique to both the vertical direction and the predetermined direction.

9. The USB receptacle as recited in claim 1, wherein:

the identifiable portion includes a first identifiable portion and a second identifiable portion;

the detector includes a first detector and a second detector;

the first detector and the second detector are connectable to the first identifiable portion and the second identifiable portion, respectively; and the first detector and the second detector are held at the opposite side portions of the holding member in the pitch direction, respectively.

* * * * *